US011783746B2

(12) United States Patent
Lee et al.

(10) Patent No.: US 11,783,746 B2
(45) Date of Patent: Oct. 10, 2023

(54) PIXEL HAVING REDUCED NUMBER OF CONTACT POINTS, AND DIGITAL DRIVING METHOD

(71) Applicant: SAPIEN SEMICONDUCTORS INC., Ulsan (KR)

(72) Inventors: Jae Hoon Lee, Busan (KR); Jin Woong Jang, Suwon-si (KR)

(73) Assignee: SAPIEN SEMICONDUCTORS INC., Ulsan (KR)

( * ) Notice: Subject to any disclaimer, the term of this patent is extended or adjusted under 35 U.S.C. 154(b) by 0 days.

(21) Appl. No.: 17/777,703

(22) PCT Filed: Nov. 12, 2020

(86) PCT No.: PCT/KR2020/015902
§ 371 (c)(1),
(2) Date: May 18, 2022

(87) PCT Pub. No.: WO2021/125568
PCT Pub. Date: Jun. 24, 2021

(65) Prior Publication Data

US 2022/0406236 A1 Dec. 22, 2022

(30) Foreign Application Priority Data

Dec. 18, 2019 (KR) ..... 10-2019-0169783
Nov. 3, 2020 (KR) ..... 10-2020-0145446

(51) Int. Cl.
*G09G 3/20* (2006.01)

(52) U.S. Cl.
CPC ..... *G09G 3/20* (2013.01); *G09G 3/2096* (2013.01); *G09G 2300/0857* (2013.01);
(Continued)

(58) Field of Classification Search
CPC ..... G09G 3/20; G09G 2300/0857; G09G 2310/0267; G09G 2310/0275;
(Continued)

(56) References Cited

U.S. PATENT DOCUMENTS

2007/0279323 A1* 12/2007 Park ..... G09G 3/3283 345/55
2020/0251548 A1* 8/2020 Ohara ..... H10K 59/131

FOREIGN PATENT DOCUMENTS

KR 10-0637393 B1 10/2006
KR 10-2015-0085046 A 7/2015
(Continued)

OTHER PUBLICATIONS

International Search Report of PCT/KR2020/015902 dated Feb. 23, 2021 [PCT/ISA/210].

*Primary Examiner* — Gerald Johnson
(74) *Attorney, Agent, or Firm* — Sughrue Mion, PLLC

(57) ABSTRACT

Provided are a pixel having two contacting points and an operating method of the pixel. The pixel includes a positive power terminal and a negative power terminal which are related to power required for driving of a pixel driving circuit unit driving a plurality of light-emitting elements, wherein the positive power terminal is connected to a data driving circuit, and the negative power terminal is connected to a scan driving circuit. The pixel may be driven according to a potential difference between a signal output from the data driving circuit and a signal output from the scan driving circuit.

10 Claims, 8 Drawing Sheets

(52) U.S. Cl.
CPC ..... *G09G 2310/0267* (2013.01); *G09G 2310/0275* (2013.01); *G09G 2310/0286* (2013.01); *G09G 2310/08* (2013.01); *G09G 2330/021* (2013.01); *G09G 2330/028* (2013.01); *G09G 2360/10* (2013.01)

(58) Field of Classification Search
CPC ..... G09G 2310/0286; G09G 2310/08; G09G 2330/021; G09G 2330/028; G09G 2360/10
See application file for complete search history.

(56) References Cited

FOREIGN PATENT DOCUMENTS

| | | | |
|---|---|---|---|
| KR | 10-2016-0113328 | A | 9/2016 |
| KR | 10-2017-0111788 | A | 10/2017 |
| KR | 10-2018-0062048 | A | 6/2018 |
| KR | 10-2018-0106278 | A | 10/2018 |
| KR | 10-2019-0026438 | A | 3/2019 |
| KR | 10-2019-0063569 | A | 6/2019 |
| KR | 10-2019-0079827 | A | 7/2019 |
| KR | 10-2137636 | B1 | 7/2020 |

* cited by examiner

PIXEL HAVING REDUCED NUMBER OF CONTACT POINTS, AND DIGITAL DRIVING METHOD

CROSS REFERENCE TO RELATED APPLICATIONS

This application is a National Stage of International Application No. PCT/KR2020/015902, filed Nov. 12, 2020, claiming priority to Korean Patent Application No. 10-2019-0169783, filed Dec. 18, 2019 and Korean Patent Application No. 10-2020-0145446, filed Nov. 3, 2020, the contents of all of which are incorporated herein by reference in their entirety.

TECHNICAL FIELD

The present disclosure relates to a pixel included in a display apparatus, and more particularly, to a pixel having two contacting points connected to the outside.

BACKGROUND ART

FIG. 1 is a circuit diagram schematically illustrating a structure of a typical pixel.

Referring to FIG. 1, a pixel including three light-emitting elements R, G, and B is shown. A typical pixel needs four contacting points. That is, two contacting points Vcc and GND related to power required to drive a pixel, a contacting point Scan connected to a scan line that simultaneously turns on pixels arranged in a row direction, and a contacting point Data connected to a data line, to which a signal related to video data is input, are required.

A pixel driving circuit as above is generally implemented on a wafer by using a deposition method, etc. However, the higher the number of contacting points, the lower may be the transfer efficiency. In addition, as interest in display panels using micro LEDs has recently increased, a pixel driving circuit that is smaller than a pixel according to the related art is required. However, this also acts as a limitation on reducing the size of the pixel as the number of contacting points increases.

DESCRIPTION OF EMBODIMENTS

Technical Problem

The present disclosure provides a pixel having two contacting points, and an operating method of the pixel.

The present disclosure is not limited to the above-mentioned objective, and other objectives not mentioned herein will be clearly understood by those skilled in the art from the following description.

Technical Solution to Problem

A pixel according to the present disclosure includes a positive power terminal and a negative power terminal which are related to power required for driving of a pixel driving circuit unit driving a plurality of light-emitting elements, wherein the positive power terminal is connected to a data driving circuit, and the negative power terminal is connected to a scan driving circuit.

The pixel driving circuit unit according to the present disclosure may include a pixel memory unit storing data related to driving of the plurality of light-emitting elements, wherein the data is input through the positive power supply terminal.

The pixel driving circuit unit according to the present disclosure may further include a reference voltage supply unit configured to output a voltage for operating a circuit included in the pixel memory unit.

The reference voltage supply unit according to the present disclosure may output, to the pixel memory unit, a voltage that changes together according to a change in an electric potential of the negative power terminal.

The pixel memory unit according to the present disclosure may include at least one shift register and at least one flip-flop for operation switching of the shift register.

The pixel memory unit according to the present disclosure may receive data related to driving of the plurality of light-emitting elements, through an output terminal of a comparator having a non-inverting input terminal connected to the positive power terminal and an inverting input terminal connected to the negative power terminal.

A pixel according to the present disclosure may be a component of a display apparatus including: a display panel including a plurality of pixels; a scan driving circuit connected to any one of a plurality of scan lines connected to a negative power terminal of each of the pixels and configured to drive pixels arranged in a row direction; and a data driving circuit configured to output a signal related to driving of a plurality of light-emitting elements included in each of the pixels, through a plurality of data lines connected to a positive power terminal of each of the pixels.

The signal output from the data driving circuit according to the present disclosure may have a reference electric potential, a first electric potential higher than the reference electric potential, or a second electric potential higher than the first electric potential. In this case, the signal related to driving of the light-emitting elements may be a signal having at least one pulse that changes from the first electric potential to the second electric potential.

The scan driving circuit according to the present disclosure may output, for each scan line, a signal having a driving data input period of a light-emitting element and a light-emitting element driving period.

A signal output from the scan driving circuit according to the present disclosure may have a reference electric potential, a first electric potential higher than the reference electric potential, or a second electric potential higher than the first electric potential. In this case, the driving data input period may include a signal having the first electric potential, and the light-emitting element driving period may include a signal having at least one pulse that changes from the reference electric potential to the first electric potential.

The scan driving circuit according to the present disclosure may output a signal having the second electric potential after the light-emitting element driving period and before a driving data input period of a next frame.

Other details of the present disclosure are included in the detailed description and drawings.

Advantageous Effects of Disclosure

According to an aspect of the present disclosure, the number of contacting points required for signal transmission is reduced compared to that of a pixel according to the related art, and thus, the yield and efficiency may be increased in a process of manufacturing a pixel on a wafer.

According to another aspect of the present disclosure, a pixel having a compact size which is realized by a reduced number of contacting points may be manufactured, and thus, the pixel may be suitable as a driving circuit for a small-sized display or a micro LED.

According to another aspect of the present disclosure, even when a signal for driving a light-emitting element has a relatively small voltage, a signal-to-noise ratio (SNR) is increased, thereby allowing accurate signal detection.

The effects of the present disclosure are not limited to the above-mentioned effects, and other effects not mentioned herein will be clearly understood by those skilled in the art from the following description.

MODE OF DISCLOSURE

Figure 1:
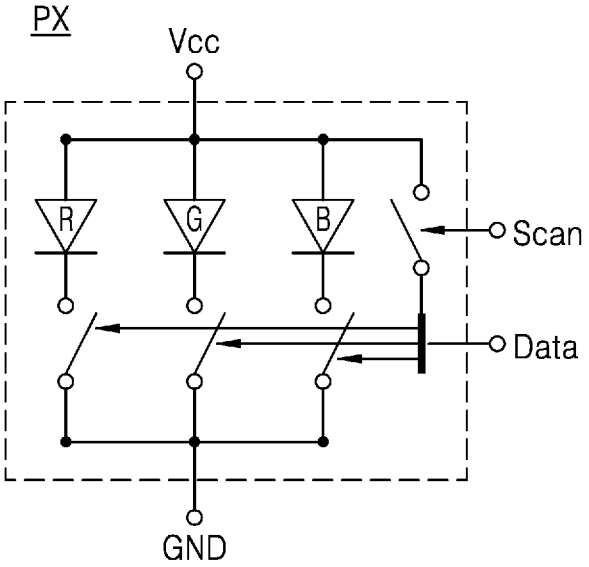
FIG. 1 is a circuit diagram schematically illustrating a structure of a typical pixel.

The advantages and features disclosed in the present disclosure, and ways to achieve them will become apparent by referring to embodiments that will be described later in detail with reference to the attached drawings. However, the present disclosure is not limited to the embodiments disclosed below, but may be implemented in various different forms, and the present embodiments are provided so that this disclosure will be thorough and complete, and will fully convey the scope of the present disclosure to those of ordinary skill in the art, to which this disclosure belongs, and the scope of the present disclosure is only defined by the scope of the claims.

The terminology used herein is for the purpose of describing the embodiments and is not intended to limit the scope of the present disclosure. In this specification, the singular also includes the plural unless specifically stated otherwise in the phrase. As used herein, "comprises" and/or "comprising" does not exclude the presence or addition of one or more other components in addition to the stated components. Like reference numerals refer to like elements throughout the specification, and "and/or" includes each and every combination of one or more of the recited elements. Although "first", "second", etc. are used to describe various components, these components are not limited by these terms. These terms are only used to distinguish one component from another. Accordingly, it is obvious that a first component described below may be a second component within the spirit and scope of the present disclosure.

Unless otherwise defined, all terms (including technical and scientific terms) used herein will have the meaning commonly understood by those of ordinary skill in the art to which the present disclosure belongs. In addition, unless defined apparently, terms as defined in a commonly used dictionary should not be ideally or excessively interpreted. Hereinafter, embodiments of the present disclosure will be described in detail with reference to the accompanying drawings.

Figure 2:
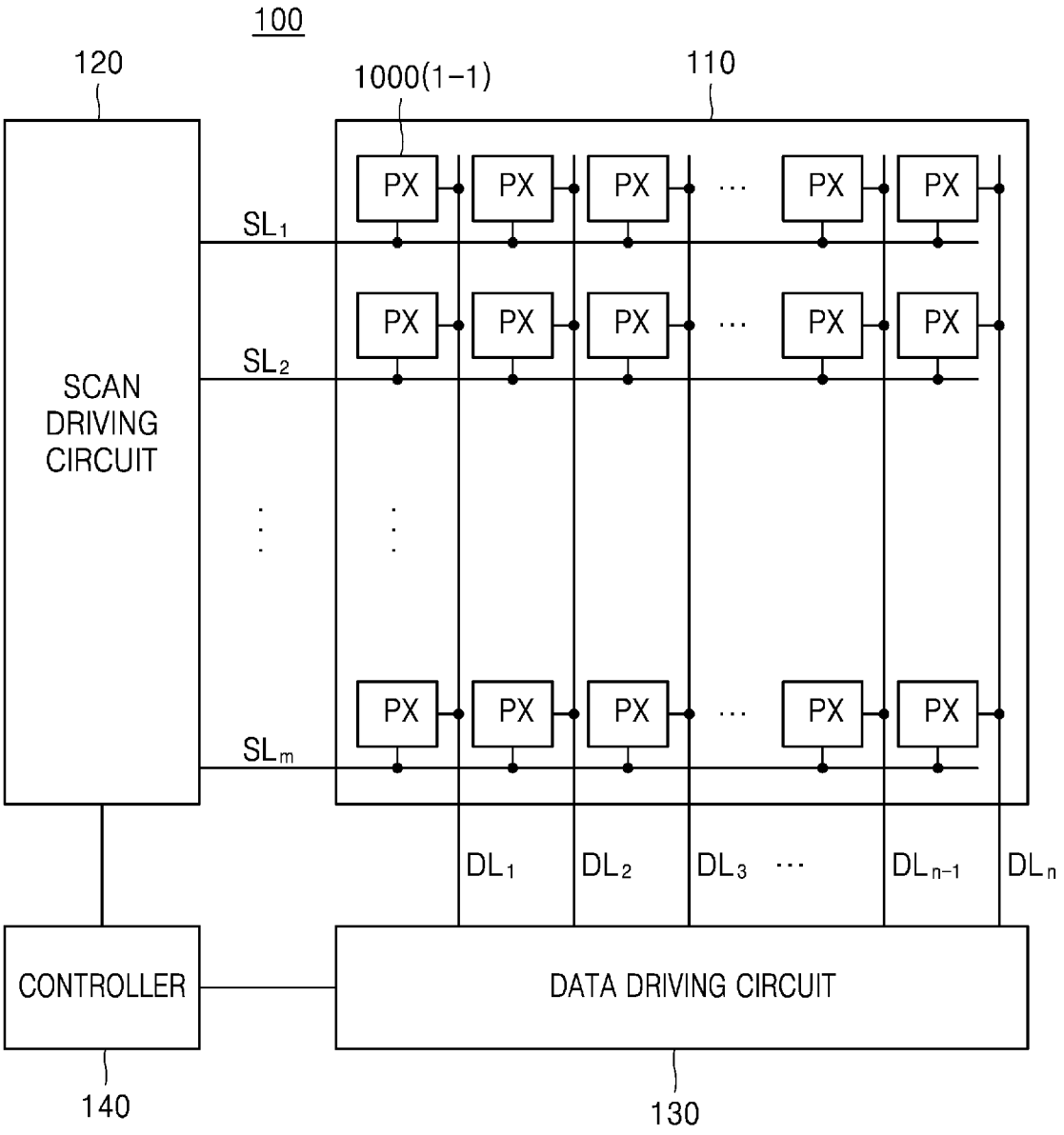
FIG. 2 is a display apparatus including a plurality of pixels according to the present disclosure.

FIG. 2 is a display apparatus including a plurality of pixels according to the present disclosure.

Referring to FIG. 2, a display apparatus 100 according to the present disclosure may include a display panel 110, a scan driving circuit 120, a data driving circuit 130, and a controller 140.

The display panel 110 may include a plurality of pixels PX according to the present disclosure. The plurality of, m×n pixels PX (m and n are natural numbers) may be arranged in a matrix form. However, a pattern in which the plurality of pixels are arranged may be, for example, a zigzag type, and the pixels may be arranged in various patterns according to embodiments.

The display panel 110 may be implemented by one of a liquid crystal display (LCD), a light-emitting diode (LED) display, an organic LED (OLED) display, an active-matrix OLED (AMOLED) display, an electrochromic display (ECD), a digital mirror device (DMD), an actuated mirror device (AMD), a grating light valve (GLV), a plasma display panel (PDP), an electro luminescent display (ELD), and a vacuum fluorescent display (VFD), or other types of flat panel displays or flexible displays. In the present disclosure, an LED display panel will be described as an example.

Each pixel PX may include a plurality of light-emitting elements. The light-emitting elements may be a light-emitting diode (LED). The light-emitting diode may be a micro LED having a size of 80 μm or less. One pixel PX may output various colors through a plurality of light-emitting elements having different colors. For example, one pixel PX may include light-emitting elements including red, green, and blue colors. As another example, when a white light-emitting element may be further included, the white light-emitting element may replace any one of the red, green, and blue light-emitting elements. Each light-emitting element included in one pixel PX is called a 'sub pixel'.

Each pixel PX may include a pixel driving circuit for driving a plurality of sub-pixels. The pixel driving circuit may drive a turn-on or turn-off operation of a sub-pixel according to a control signal output from the scan driving circuit 120 and/or the data driving circuit 130. The pixel driving circuit may include at least one thin-film transistor and at least one capacitor. The pixel driving circuit may be implemented by a stacked structure on a semiconductor wafer.

The display panel 110 may include scan lines $SL_1$ to $SL_m$ arranged in a row direction and data lines $DL_1$ to $DL_n$ arranged in a column direction. The pixels PX may be positioned at intersections of the scan lines $SL_1$ to $SL_m$ and the data lines $DL_1$ to $DL_n$. Each pixel PX may be connected to any one scan line $SL_k$ and any one data line $DL_k$. The scan lines $SL_1$ to $SL_m$ may be connected to the scan driving circuit 120, and the data lines $DL_1$ to $DL_n$ may be connected to the data driving circuit 130.

The scan driving circuit 120 may drive pixels connected to any one of the scan lines $SL_1$ to $SL_m$. Preferably, the scan driving circuit 120 may sequentially select the scan lines $SL_1$ to $SL_m$. For example, pixels connected to a first scan line $SL_1$ may be driven during a first scan driving period, and pixels connected to a second scan line $SL_2$ may be driven during a second scan driving period. An operation of the scan driving circuit 120 according to the present disclosure will be described in detail later.

The data driving circuit 130 may output a signal related to gradation to each pixel through the data lines $DL_1$ to $DL_n$. While one data line is connected to a plurality of pixels in a longitudinal direction, a signal related to gradation may be input only to pixels connected to a scan line selected by the scan driving circuit 120. An operation of the data driving circuit 130 according to the present disclosure will be described in detail later.

The controller 140 may output a control signal so that operations of the scan driving circuit 120 and the data driving circuit 130 are performed. The controller 140 may output a control signal corresponding to image data corresponding to one image frame, to each of the scan driving circuit 120 and the data driving circuit 130.

Figure 3:
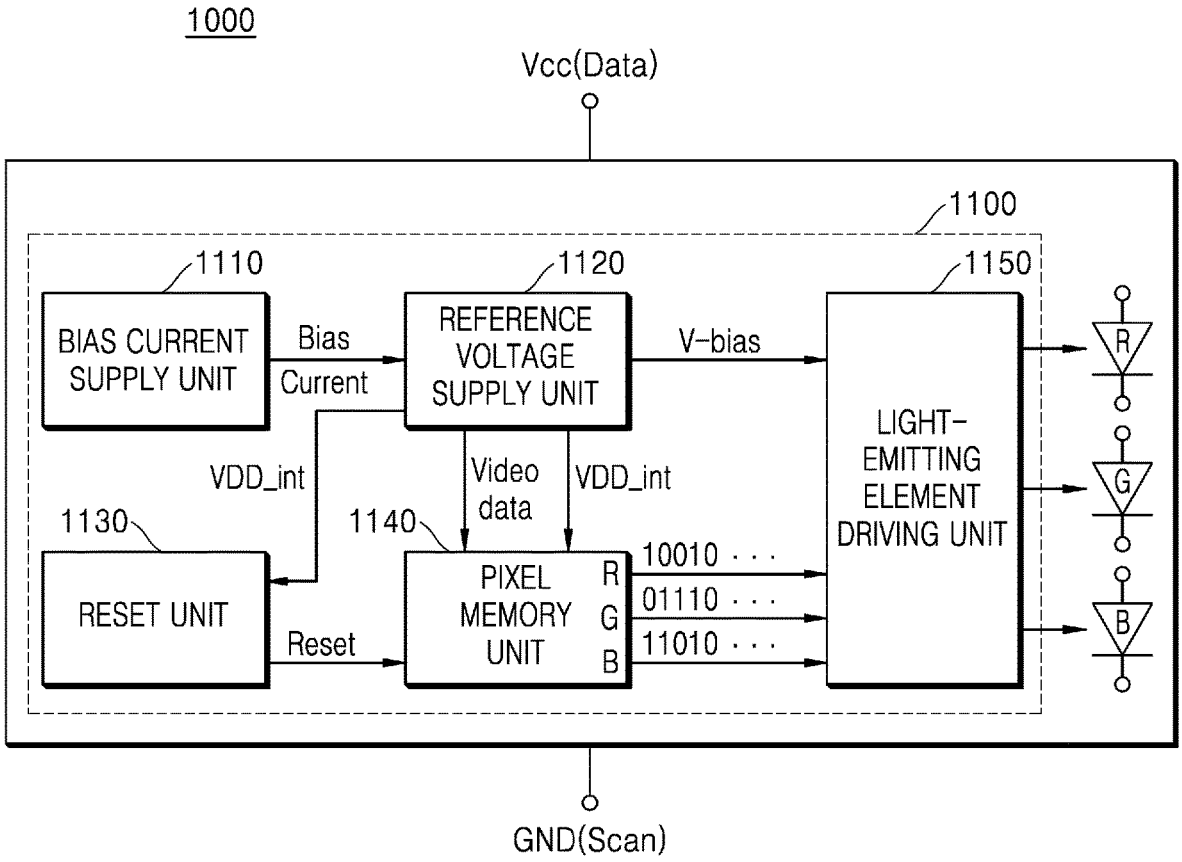
FIG. 3 is a schematic block diagram illustrating a configuration of a pixel according to the present disclosure.

FIG. 3 is a schematic block diagram illustrating a configuration of a pixel according to the present disclosure.

Referring to FIG. 3, a pixel 1000 according to the present disclosure may include a plurality of light-emitting elements R/G/B and a pixel driving circuit unit 1100. According to an embodiment, the plurality of light-emitting elements may be micro-LEDs. The pixel driving circuit unit 1100 has a function of driving the plurality of light-emitting elements. That is, the pixel driving circuit unit 1100 may have a function of controlling the plurality of light-emitting elements to operate according to the color and brightness of light to be output by a pixel for each frame.

A positive power terminal Vcc and a negative power terminal GND are contacting points related to power required for driving the plurality of light-emitting elements R/G/B and the pixel driving circuit unit 1100. Accordingly, all electric energy required for an operation of the pixel 1000 according to the present disclosure may be supplied according to a potential difference between the positive power terminal Vcc and the negative power terminal GND. The positive power terminal Vcc may be connected to the data driving circuit 130, and the negative power terminal GND may be connected to the scan driving circuit 120.

The pixel 1000 according to the present disclosure includes the positive power terminal Vcc and the negative power terminal GND as contacting points electrically connected to the outside. Compared with the pixel illustrated in FIG. 1, it can be seen that the pixel 1000 according to the present disclosure has two fewer contacting points. Thus, in order to operate as a pixel of a display panel despite relatively few contacting points, the positive power terminal Vcc of the pixel 1000 according to the present disclosure is connected to the data driving circuit 130, and the negative power terminal GND is connected to the scan driving circuit 120. That is, the pixel 1000 operates due to a potential difference between a signal output from the data driving circuit 130 and a signal output from the scan driving circuit 120.

The pixel driving circuit unit 1100 may include a pixel memory unit 1140. The pixel memory unit 1140 may store data related to driving of a plurality of light-emitting elements, input through the positive power terminal Vcc. A signal related to driving of the plurality of light-emitting elements may be a signal input in a digital format. That is, the display panel 110 according to the present disclosure may be a device having pixels that are driven digitally.

The pixel driving circuit unit 1100 may further include a reference voltage supply unit 1120 that outputs a voltage for operating a circuit included in the pixel memory unit 1140.

In addition, the pixel driving circuit unit 1100 may further include a bias current supply unit 1110, a reset unit 1130, and a light-emitting element driving unit 1150. The light-emitting element driving unit 1150 is configured to drive the plurality of light-emitting elements according to driving data of each light-emitting element, stored in the pixel memory unit 1140. The light-emitting element driving unit 1150 may be a circuit that drives the light-emitting elements using a pulse width modulation (PWM) method. The PWM driving method is a technique known to those skilled in the art, and thus, a detailed description thereof will be omitted.

The bias current supply unit 1110, the reference voltage supply unit 1120, and the reset unit 1130 will be described in detail later.

Referring to FIGS. 2 and 3 together, the operating principle of the pixel 1000 and the display apparatus 100 according to the present disclosure will be described.

Figure 4:
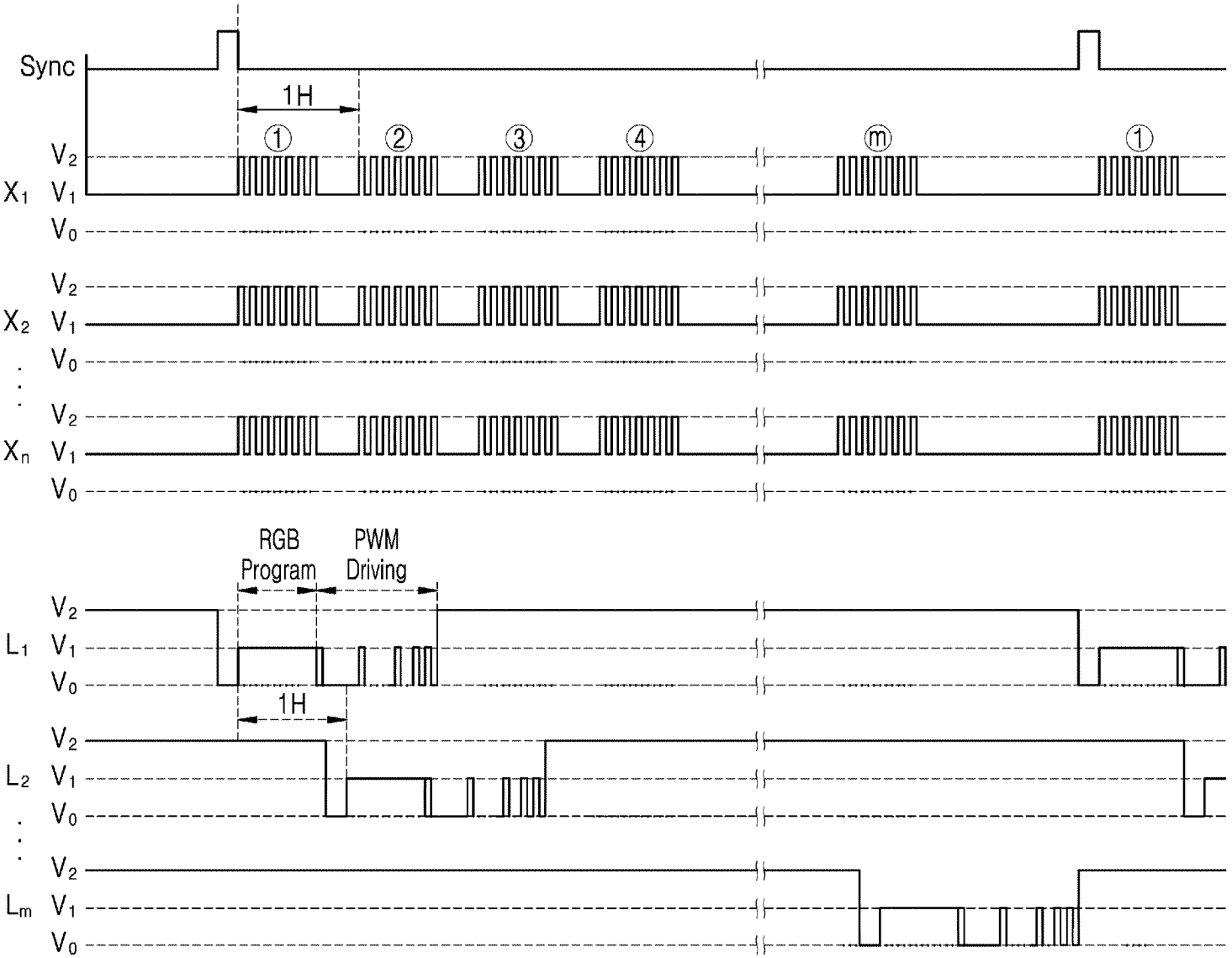
FIG. 4 is a waveform diagram of a signal output to drive a pixel in a display apparatus according to the present disclosure.

FIG. 4 is a waveform diagram of a signal output to drive a pixel in the display apparatus according to the present disclosure.

Referring to FIG. 4, a signal Sync for matching the operations of the scan driving circuit 120 and the data driving circuit 130 to each other, for each frame, may be identified. The sync signal Sync may be output from the controller 140 that controls the scan driving circuit 120 and the data driving circuit 130.

A signal output from the data driving circuit 130 may have a reference electric potential $V_0$, a first electric potential $V_1$ higher than the reference electric potential $V_0$, or a second electric potential $V_2$ that is higher than the first electric potential $V_1$. For example, the reference electric potential $V_0$ may be a reference ground voltage of the display apparatus, and the first electric potential $V_1$ may have a potential difference of 0.7 V or more from the reference electric potential $V_0$, and the second electric potential $V_2$ may have a potential difference of 0.7 V or more from the first electric potential $V_1$. In addition, a signal output from the data driving circuit 130, that is, a signal related to driving of the light-emitting elements, may be a signal having at least one pulse that changes from the first electric potential $V_1$ to the second electric potential $V_2$. Data of '0' or '1' may be expressed according to a length of the pulse.

The scan driving circuit 120 may output a signal for driving the pixel 1000 for each scan line according to a timing of the sync signal Sync. A signal for driving the pixel 1000 may have a driving data input period RGB Program of a light-emitting element and a light-emitting element driving period PWM Driving.

A signal output from the scan driving circuit 120 may also have a reference electric potential $V_0$, a first electric potential $V_1$ higher than the reference electric potential $V_0$, or a second electric potential $V_2$ that is higher than the first electric potential $V_1$. For example, the reference electric potential $V_0$ may be a reference ground voltage of the display apparatus, and the first electric potential $V_1$ may have a potential difference of 0.7 V or more from the reference electric potential $V_0$, and the second electric potential $V_2$ may have a potential difference of 0.7 V or more from the first electric potential $V_1$. That is, the reference electric potential $V_0$, the first electric potential $V_1$, and the second electric potential $V_2$ of the signal output from the data driving circuit 130 may be the same as each other.

In the signal output from the scan driving circuit 120, the driving data input period RGB Program may be a signal having the first electric potential $V_1$. The driving data input period RGB Program may consist of one pulse. The light-emitting element driving period PWM Driving may be a signal having at least one pulse that changes from the reference electric potential $V_0$ to the first electric potential $V_1$. The light-emitting element driving period PWM Driving is a region for PWM driving of a light-emitting element, and the number of pulses in the light-emitting element driving period PWM Driving may correspond to a bit size of data related to driving of the light-emitting element.

As described above, the pixel 1000 may be driven when there is a constant potential difference between the positive power terminal Vcc and the negative power terminal GND of the pixel 1000 according to the present disclosure. During the driving data input period RGB Program and the light-emitting element driving period PWM Driving, the data driving circuit 130 may apply a voltage between the first electric potential $V_1$ and the second electric potential $V_2$, to the positive power terminal Vcc, and the scan driving circuit 120 may apply a voltage between the reference electric potential $V_0$ and the first electric potential $V_1$, to the negative power terminal GND. Accordingly, during the driving data input period RGB Program and the light-emitting element driving period PWM Driving, the pixel 1000 according to the present disclosure may be driven by a potential difference between the positive power terminal Vcc and the negative power supply terminal GND. The scan driving circuit 120 may output a signal having the second electric potential $V_2$ after the light-emitting element driving period PWM Driving and before a driving data input period RGB Program of a next frame. Here, there is little potential difference between the positive power terminal Vcc and the negative power terminal GND, and thus, the pixel 1000 according to the present disclosure may not be driven.

The scan driving circuit 120 may output a signal for sequentially driving the pixel 1000, to the plurality of scan lines $SL_1$ to $SL_m$. Here, the scan driving circuit 120 may output a signal delayed by a preset time interval 1H between scan lines. The preset time interval 1H may be the same as the driving data input period RGB Program.

The data driving circuit 130 may output a signal related to driving of the plurality of pixels 1000. A signal related to the driving of the pixel 1000 refers to a signal including data related to brightness of light to be output by the plurality of light-emitting elements included in the pixel 1000, within one frame. A signal output by the data driving circuit 130 to each of the data lines $DL_1$ to $DL_n$ includes data corresponding to m pixels arranged in a longitudinal direction in the display panel 110. In one data line, an interval between data signals related to driving of each pixel 1000 and output by the data driving circuit 130 may be equal to the driving data input period RGB Program.

In FIG. 4, while data signals RGB related to driving the pixel 1000 and output by the data driving circuit 130 all have the same shape, it should be understood that the shape of the signals may vary depending on colors to be expressed.

Hereinafter, how the signal illustrated in FIG. 4 is input to one pixel 1000 to drive the pixel 1000 will be described. For convenience of understanding, a 1-1 pixel 1000 where the first scan line $SL_1$ and a first data line $DL_1$ meet will be described as an example.

Figure 5:
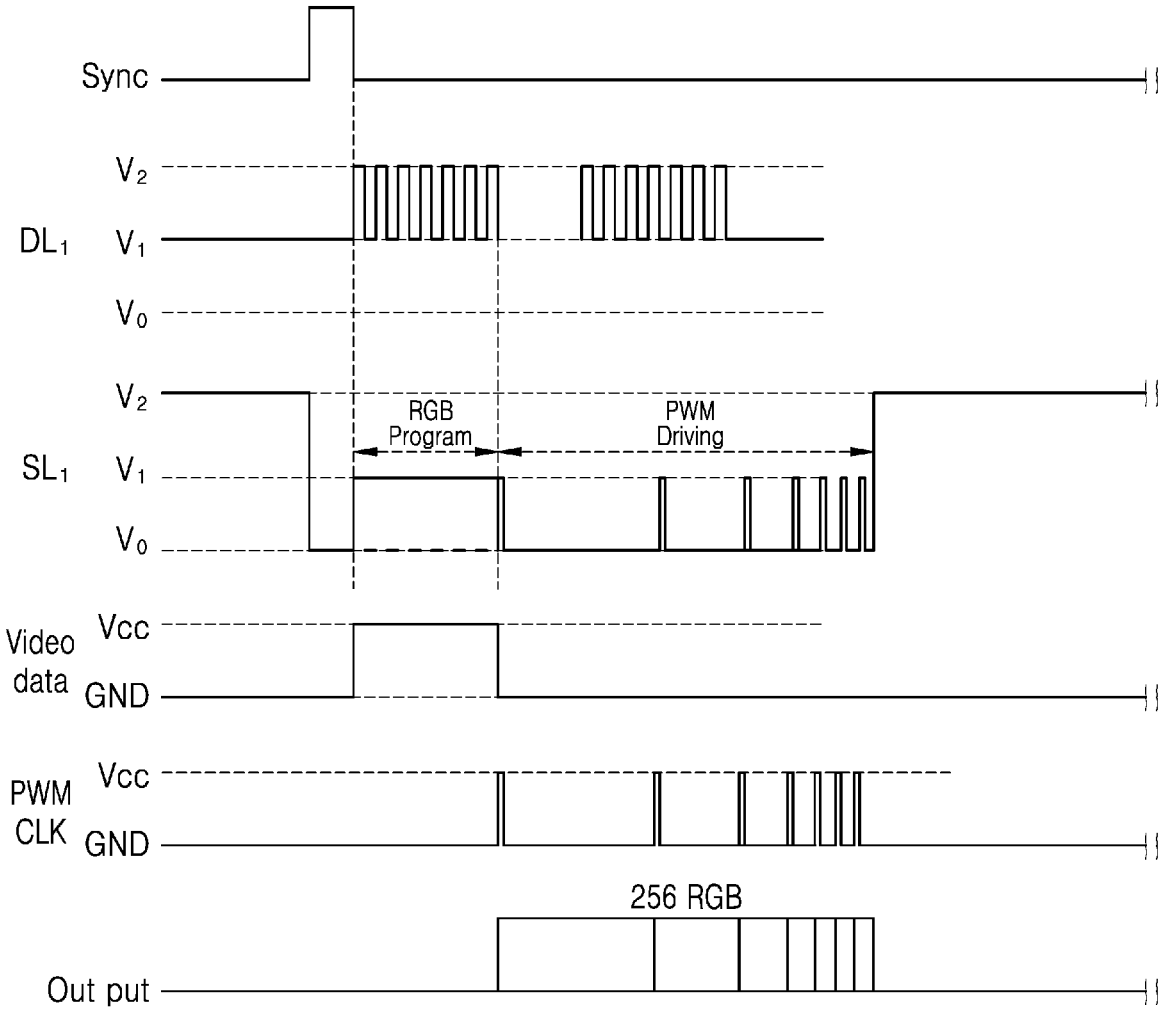
FIG. 5 is a timing reference diagram for an operation of one pixel.

FIG. 5 is a timing reference diagram for an operation of one pixel.

Referring to FIG. 5, a sync signal Sync output to the controller 140 to distinguish one frame from another. A signal input through the first data line $DL_1$ and the first scan line $SL_1$ may be checked according to the sync signal Sync. A signal through the first data line $DL_1$ is input to the positive power terminal Vcc, and a signal through the first scan line $SL_1$ is input to the negative power terminal GND. The pixel driving circuit unit 1100 may start operating due to a potential difference between the positive power terminal Vcc and the negative power terminal GND.

First, the bias current supply unit 1110 may output a bias current to the reference voltage supply unit 1120. The reference voltage supply unit 1120 may output a voltage having a preset amplitude to the reset unit 1130, the pixel memory unit 1140, and the light-emitting element driving unit 1150. Among voltages illustrated in FIG. 3, "VDD_int" refers to a voltage for operating circuits included in the reset unit 1130 and the pixel memory unit 1140, and "V-bias" refers to a voltage for driving the light-emitting element driving unit 1150. However, it is obvious that the type and amplitude of the voltage output from the reference voltage supply unit 1120 is not limited to the examples illustrated in the drawings, and may be set in various ways.

The reset unit 1130 may initialize the pixel memory unit 1140. The pixel memory unit 1140 may store a signal output from the reference voltage supply unit 1120 during a driving data input period RGB Program after being initialized, that is, a signal Video data related to driving of light-emitting elements. Thereafter, the pixel memory unit 1140 may output a signal for PWM-driving of each light-emitting element to the light-emitting element driving unit 1150 according to a PWM control signal PWM CLK input through the negative power terminal GND during the light-emitting element driving period PWM Driving. Accordingly, each of the light-emitting elements R/G/B outputs various luminances according to a PWM driving signal output to the light-emitting element driving unit 1150 (see 'Output' in FIG. 5).

Hereinafter, how the pixel memory unit 1140 operates in the driving data input period RGB Program and the light-emitting element driving period PWM Driving will be described in detail.

Figure 6:
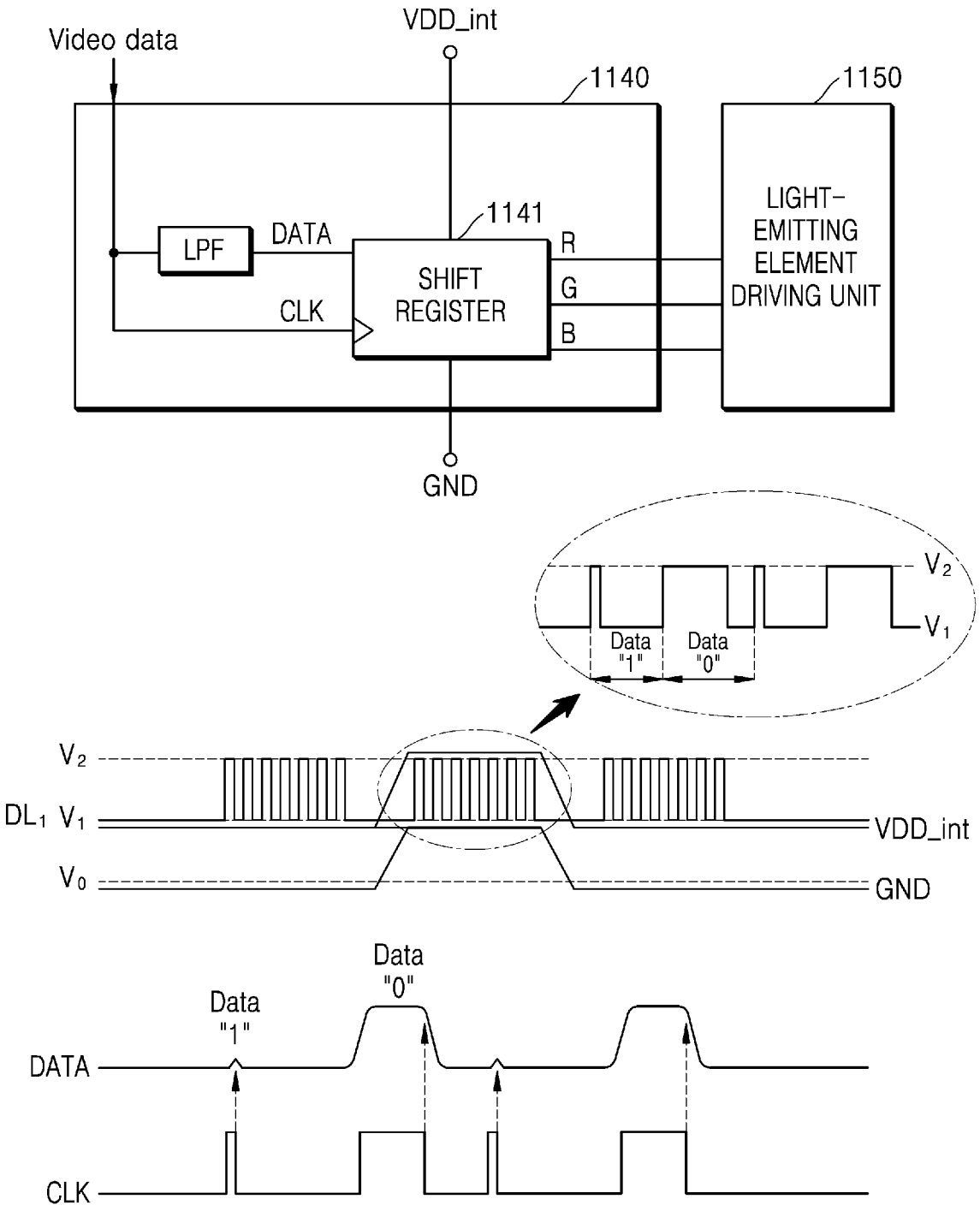
FIG. 6 is a reference diagram of an operation of a pixel memory unit in a driving data input period according to the present disclosure.

FIG. 6 is a reference diagram of an operation of a pixel memory unit in a driving data input period according to the present disclosure.

Referring to FIG. 6, the embedded pixel memory portion 1140 including a shift register 1141 is shown. The pixel memory unit 1140 may receive a voltage VDD_int for operating the shift register 1141, from the reference voltage supply unit 1120. In addition, the shift register 1141 may be connected to the negative power terminal GND. Accordingly, the shift register 1141 may be operated by a potential difference between the voltage VDD_int output from the reference voltage supply unit 1120 and the negative power terminal GND.

The reference voltage supply unit 1120 may output, to the pixel memory unit 1140, a voltage that changes together according to a change in an electric potential of the negative power terminal GND. As described above, the signal output from the scan driving circuit 120 and input through the negative power terminal GND during the driving data input period RGB Program may rise from the reference electric potential $V_0$ to the first electric potential $V_1$. Here, the reference voltage supply unit 1120 may also output a voltage that is increased by an increase in the electric potential (from $V_0$ to $V_1$) of the negative power terminal GND when data related to driving of the light-emitting elements is stored in the pixel driving circuit unit 1100, that is, during the driving data input period RGB Program. Due to the simultaneous rise of the power VDD_int supplied from the reference voltage supply unit 1120 and the electric potential output from the negative power terminal GND during the driving data input period RGB Program, a certain period may be selected from a signal output from the data driving circuit 130 and input to the shift register 1141.

Meanwhile, the data Video data related to driving of the light-emitting elements, input through the positive power supply terminal Vcc is branched, and one piece of the data may be directly input to the shift register 1141, and the other piece of the data may pass through a low pass filter LPF and input to the shift register 1141. A signal that has passed through the low-pass filter LPF may be input as 'CLK' of the shift register 1141, and a signal that has not passed through the low-pass filter LPF may be input as 'DATA' of the shift register 1141. '0' or '1' may be input based on an input potential difference between the two signals.

In addition, the pixel 1000 according to the present disclosure may further include a comparator to improve robustness from noise of data signals related to driving of a plurality of light-emitting elements input through the positive power terminal.

Figure 7:
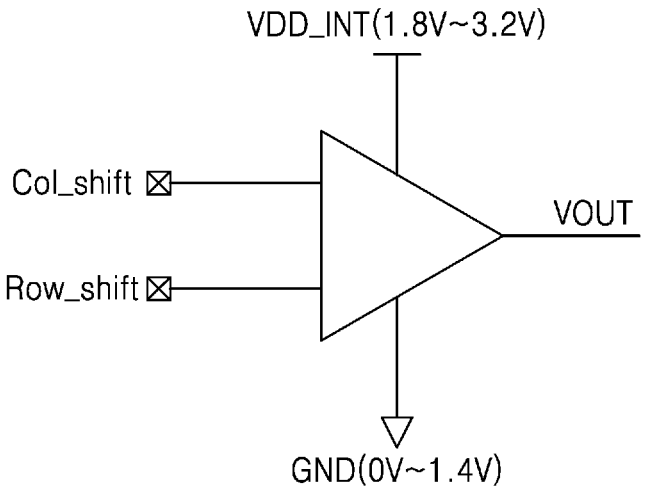
FIG. 7 is a reference diagram of a comparator for outputting data related to driving of a light-emitting element to a pixel memory unit according to the present disclosure.

FIG. 7 is a reference diagram of a comparator for outputting data related to driving of a light-emitting element to an embedded pixel memory portion according to the present disclosure.

Referring to FIG. 7, a non-inverting input terminal Col_shift ('+') of the comparator may be connected to the positive power supply terminal Vcc, and an inverting input terminal Row_shift ('−') of the comparator may be connected to the negative power supply terminal GND. In addition, an output terminal Vout of the comparator may be connected to the pixel memory unit 1140. Referring to FIG. 6 above, the power VDD_int supplied from the reference voltage supply unit 1120 and the electric potential output from the negative power terminal GND should rise together, and a voltage difference therebetween needs to maintain a certain value (e.g., 0.7 V or 1 V) or more in order to allow a signal output from the data driving circuit 130, to be input to the shift register 1141. Here, when the voltage difference falls to a certain value of therebelow due to an external impact, data related to driving of the light-emitting element may not be accurately input to the shift register 1141. However, as illustrated in FIG. 7, by amplifying a voltage level difference between the positive power supply terminal Vcc and the negative power supply terminal GND through the comparator, and inputting the voltage level difference as data related to driving of the plurality of light-emitting elements, to the shift register 1141, data may be accurately input despite an external impact. That is, signal-to-noise characteristics may be robust.

Figure 8:
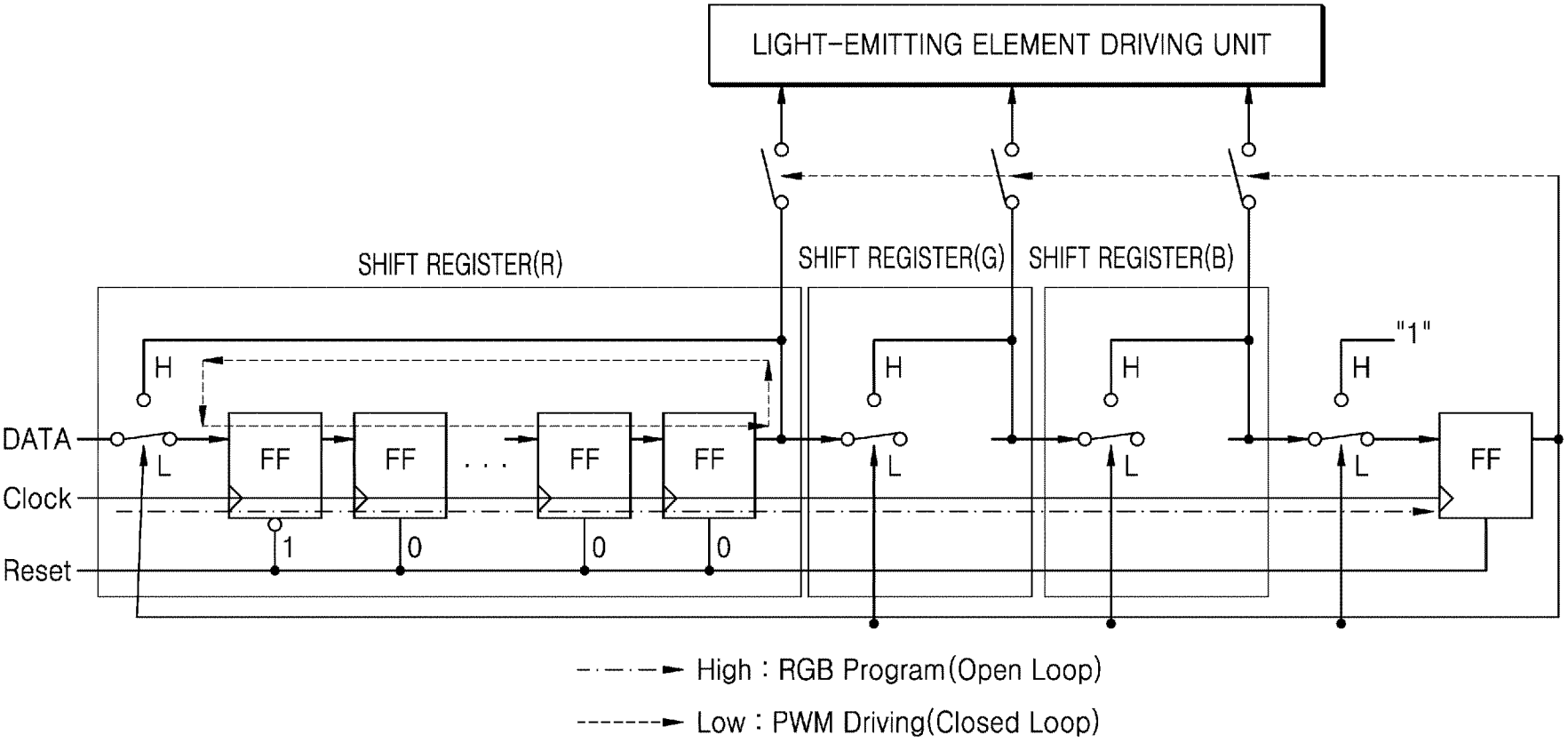
FIG. 8 is a schematic block diagram illustrating a configuration of a pixel memory unit according to an embodiment of the present disclosure.

FIG. 8 is a schematic block diagram illustrating a configuration of the pixel memory unit 1140 according to an embodiment of the present disclosure.

Referring to FIG. 8, the pixel memory unit 1140 includes three shift registers and one flip-flop. Each of the shift registers may include a plurality of flip-flops. In general, one pixel includes three light-emitting elements. For example, data related to driving of each light-emitting element in the one frame may be 8 bits. In this case, the pixel memory unit 1140 may include three shift registers each capable of storing 8 bits. As another example, data related to driving of each light-emitting element in the one frame may be 11 bits, which is extended from 8 bits, for gamma correction or mismatch correction. In this case, the pixel memory unit 1140 may include three shift registers each capable of storing 11 bits. The three shift resistors may be connected in series, and data related to driving of the light-emitting elements may be sequentially input thereto.

Meanwhile, the pixel memory unit 1140 may include at least one flip-flop for switching the operation of the shift registers. The operation switching of the shift registers refers to data writing and output switching in the driving data input period RGB Program and the light-emitting element driving period PWM Driving. The flip-flop for operation switching of the shift registers may be located at a last end at an input terminal of the shift registers. Accordingly, data output from the data driving circuit 130 may further include an additional 1 bit in addition to the data related to driving of the light-emitting elements. For example, a signal output from the data driving circuit 130 during one frame may be 25 bits (=8 bits×3+1 bit) or 34 bits (=11 bits×3+1 bit).

The additional 1 bit is included in a first portion of a signal, but arrives last at the flip-flop for switching the operation of the shift registers. When the additional 1 bit is input to the flip-flop, a signal may be output to a switching circuit so that the shift registers may output the stored data to the light-emitting element driving unit 1150.

While the present disclosure has been particularly shown and described with reference to embodiments thereof, it will be understood by those of ordinary skill in the art that various changes in form and details may be made therein without departing from the spirit and scope of the present disclosure as defined by the appended claims. Therefore, the embodiments described above should be considered in a descriptive sense only and not for purposes of limitation.

The invention claimed is:

1. A pixel comprising a positive power terminal and a negative power terminal which are related to power required for driving of a pixel driving circuit unit driving a light-emitting element, wherein the positive power terminal is connected to a data driving circuit, and the negative power terminal is connected to a scan driving circuit, and wherein the pixel driving circuit unit comprises a pixel memory unit storing data related to driving of the light-emitting element, and the data is input through the positive power terminal.

2. The pixel of claim 1, wherein the pixel driving circuit unit further comprises a reference voltage supply unit configured to output a voltage for operating a circuit included in the pixel memory unit.

3. The pixel of claim 2, wherein the reference voltage supply unit outputs, to the pixel memory unit, a voltage that changes together according to a change in an electric potential of the negative power terminal.

4. The pixel of claim 1, wherein the pixel memory unit comprises at least one shift register and at least one flip-flop for operation switching of the shift register.

5. The pixel of claim 1, wherein the pixel memory unit receives data related to driving of the light-emitting element, through an output terminal of a comparator having a non-inverting input terminal connected to the positive power terminal and an inverting input terminal connected to the negative power terminal.

6. A display apparatus comprising:

a display panel including a pixel from among the plurality of pixels of claim 1;

a scan driving circuit connected to any one of a plurality of scan lines connected to a negative power terminal of each of the pixels and configured to drive pixels arranged in a row direction; and a data driving circuit configured to output a signal related to driving of a plurality of light-emitting elements included in each of the pixels, through a plurality of data lines connected to a positive power terminal of each of the pixels.

7. The display apparatus of claim 6, wherein the signal output from the data driving circuit has a reference electric potential, a first electric potential higher than the reference electric potential, or a second electric potential higher than the first electric potential, and the signal related to driving of the light-emitting elements is a signal having at least one pulse that changes from the first electric potential to the second electric potential.

8. The display apparatus of claim 6, wherein the scan driving circuit outputs, for each scan line, a signal having a driving data input period of a light-emitting element and a light-emitting element driving period.

9. The display apparatus of claim 8, wherein a signal output from the scan driving circuit has a reference electric potential, a first electric potential higher than the reference electric potential, or a second electric potential higher than the first electric potential, and the driving data input period comprises a signal having the first electric potential, and the light-emitting element driving period comprises a signal having at least one pulse that changes from the reference electric potential to the first electric potential.

10. The display apparatus of claim 9, wherein the scan driving circuit outputs a signal having the second electric potential after the light-emitting element driving period and before a driving data input period of a next frame.

* * * * *